United States Patent [19]

Noble et al.

[11] Patent Number: 4,730,605

[45] Date of Patent: Mar. 15, 1988

[54] PERCUSSING BODY MASSAGER HAVING AMPLITUDE ADJUSTMENT MEANS

[75] Inventors: Edward D. Noble, Willowdale; Duke Harding, Markham, both of Canada

[73] Assignee: Wellness Innovations Corp., Markham, Canada

[21] Appl. No.: 884,851

[22] Filed: Jul. 14, 1986

[51] Int. Cl.[4] ..... A61H 23/02

[52] U.S. Cl. ..... 128/55; 128/44; 128/52

[58] Field of Search ..... 128/44, 32, 45, 46, 128/48, 49, 54, 55, 52; D24/41

[56] References Cited

U.S. PATENT DOCUMENTS

| | | | |
|---|---|---|---|
| D. 261,428 | 10/1981 | Noble | D24/41 |
| 2,038,846 | 4/1936 | Matson | 128/46 |
| 2,110,069 | 3/1938 | McGaw | 128/49 |
| 2,206,902 | 7/1940 | Kost | 128/46 |
| 2,542,221 | 2/1951 | Walters | 128/46 |
| 2,714,381 | 8/1955 | Corley et al. | 128/46 |
| 2,964,037 | 12/1960 | Johnston | 128/49 |
| 4,061,137 | 12/1977 | Sandt | 128/46 |
| 4,150,668 | 4/1979 | Johnston | 128/49 |
| 4,430,992 | 2/1984 | Christ | 128/46 |

*Primary Examiner*—Edgar S. Burr
*Assistant Examiner*—Tonya Lamb
*Attorney, Agent, or Firm*—Rogers, Bereskin & Parr

[57] ABSTRACT

A body massager includes a casing having handles at opposite sides disposed in planes mutually at right angles, for ease of manipulation of the massager. A massage head is mounted in the casing for pivotal rocking movement about a transverse axis and has a contoured massage surface for imparting a percussive massage action to a patient. The massage head is driven from an electric motor by a dynamically balanced eccentric driving a connecting rod connected to the massage head by way of a resilient link that can be adjusted to vary the amplitude of the rocking motion.

10 Claims, 9 Drawing Figures

PERCUSSING BODY MASSAGER HAVING AMPLITUDE ADJUSTMENT MEANS

FIELD OF THE INVENTION

This invention relates generally to power operated body massagers.

BACKGROUND OF THE INVENTION

Traditionally, doctors, chiropractors and other professional therapists have used power operated massagers to give treatment involving manipulation of body structures. Therapy of this type has been found particularly effective in treating muscle tension and fatigue, for example in athletes.

DESCRIPTION OF THE PRIOR ART

Generally, most prior art massagers have operated by exerting an orbital rubbing action on the body. However, this type of action often causes irritation or other discomfort to the patient. Further, it is now thought that the therapeutic effect of this type of rubbing action may not be particularly beneficial and that a percussive massage action may be preferred. Massagers operating on this principle have previously been proposed. Examples are shown in U.S. Pat. No. Des. 261,428 and in U.S. Pat. No. 4,150,668.

An object of the present invention is to provide improvements in power operated massagers of the percussive type.

SUMMARY OF THE INVENTION

According to one aspect of the invention there is provided a body massager comprising a base structure including a casing having handles for use by an operator in manipulating the massager, a drive unit carried by the base structure, a massage head having an external massage surface contoured symmetrically about a transverse centre line for percussive massage of the body, the massage head being coupled to the base structure for pivotal rocking movement about an axis disposed parallel to said transverse centre line, and means coupling the motor with the massage head to reciprocate the massage head in a direction generally normal to said axis at a position spaced from said centre line and thereby produce said rocking movement of the head. The coupling means includes a resilient link which is alternately compressed and relaxed during reciprocation, and adjustable means constraining the link to limit the extent of said compression and relaxation at each reciprocation, and thereby control the amplitude of the pivotal rocking movement of the massage head.

In summary, a massager of this form has the advantage that the amplitude of the pivotal rocking movement of the massage head can be adjusted to vary the percussive massage effect as required. For example, for some treatments, it may be desirable to provide for a maximum amplitude of percussive massage, to penetrate deep into the body and obtain a desired therapeutic effect. In other cases, lighter massage may be desirable.

Another aspect of the invention provides a massager of the form defined above which may or may not include the said resilient link and adjustable constraining means but in which two handles are provided on the casing of the massager and are disposed one at each side of the casing generally at opposite ends of the said pivotal axis of the massage head. Each handle comprising a generally U-shaped formation extending outwardly of the casing with one handle disposed generally parallel to a general plane containing the massage head and the other handle disposed at right angles to the said plane.

In other words, the two handles of the casing are disposed mutually at right angles, one generally horizontal and one vertical considering the massager disposed on a horizontal surface. This handle arrangement has been found to be particularly useful in that it allows the massager to be held in an almost infinite variety of positions as required by the particular treatment being given.

BRIEF DESCRIPTION OF THE DRAWINGS

In order that the invention may be more clearly understood, reference will now be made to the accompanying drawings which illustrate a particular preferred embodiment of the invention by way of example, and in which.

DESCRIPTION OF THE PREFERRED EMBODIMENTS

Figure 1:
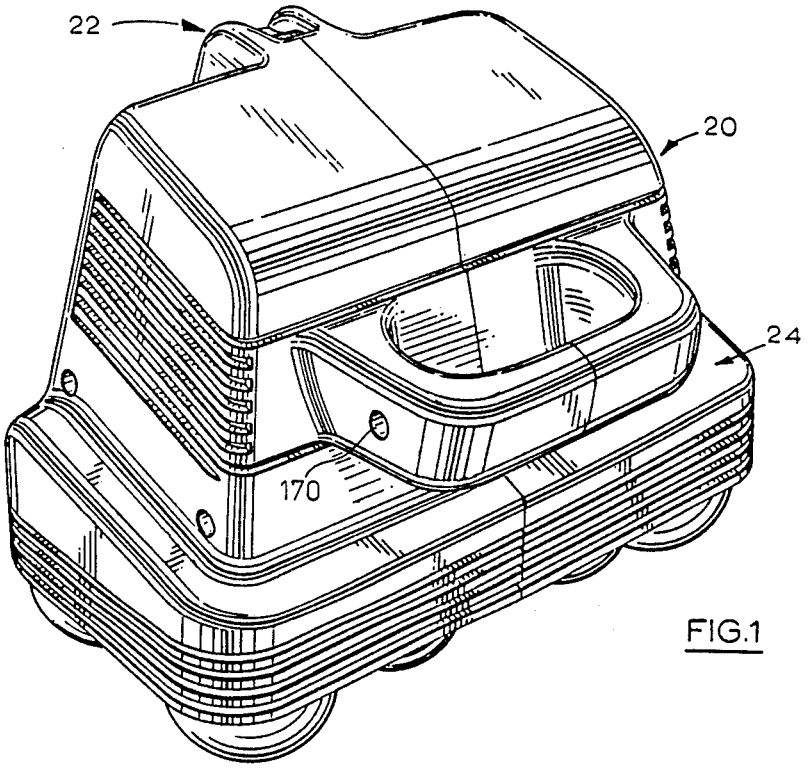
FIGS. 1 and 2 are perspective views from opposite sides and above of a massager in accordance with one embodiment of the invention.
Figure 2:
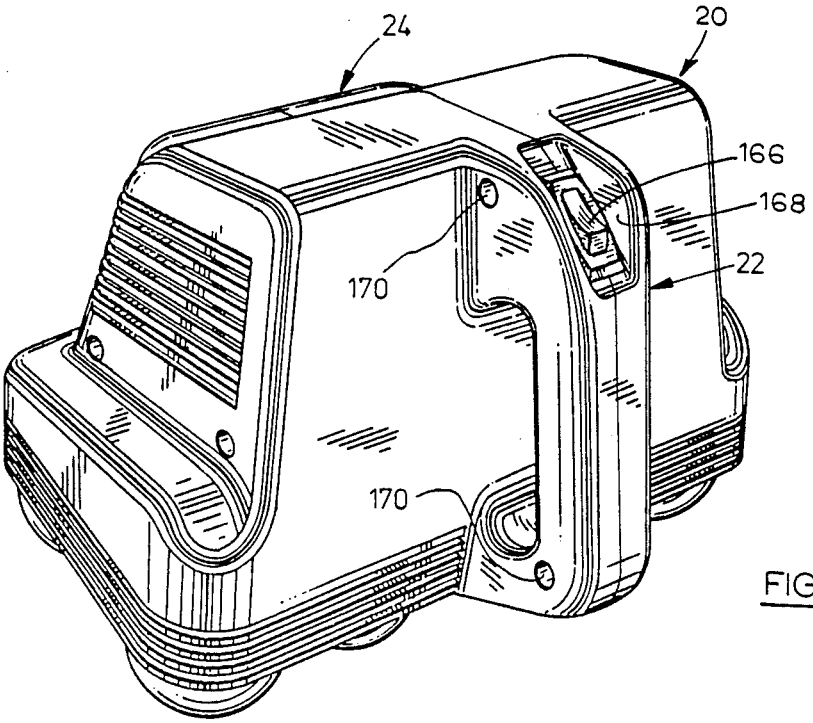
Figure 3:
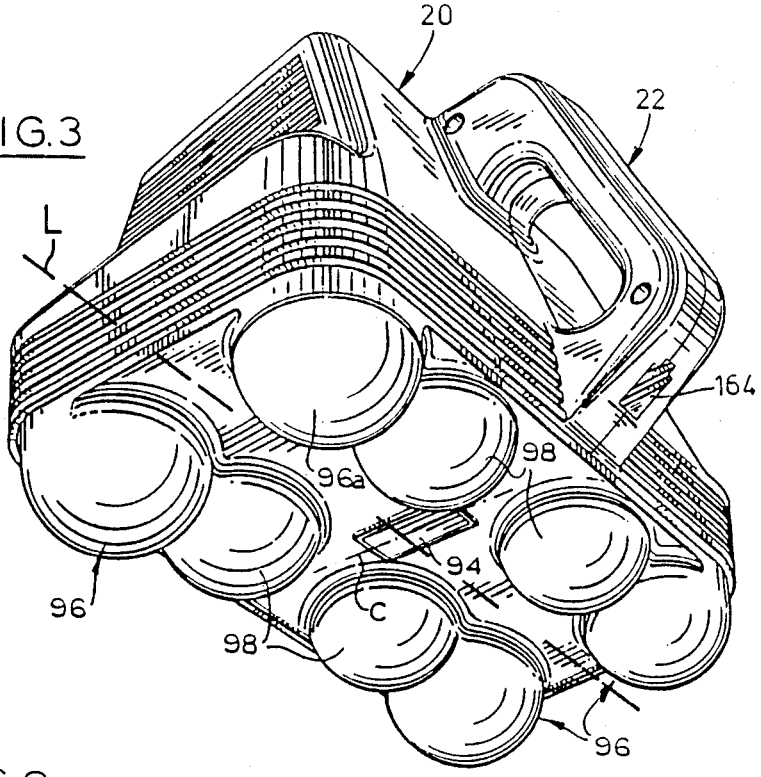
FIG. 3 is a perspective view from below and from the same side as FIG. 2.
Figure 4:
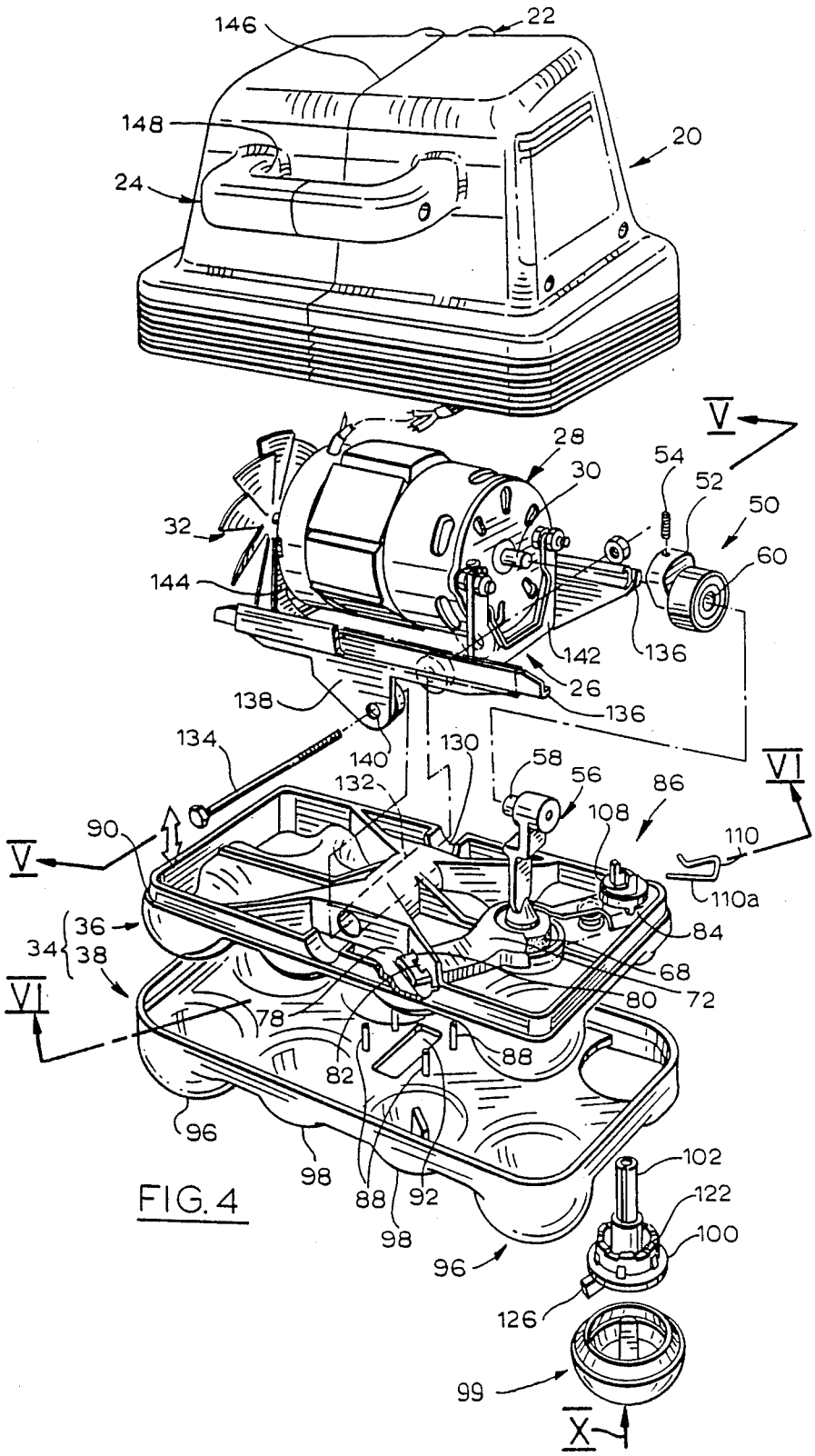
FIG. 4 is an exploded perspective view of the massager as seen from the same side as FIG. 1 and the opposite end.

Referring now to the drawings, FIGS. 1 to 3 show the external appearance of the massager while FIGS. 4 to 9 illustrate its internal structure. The massager has a casing generally denoted by reference numeral 20 (FIGS. 1 to 4) having handles 22, 24 at opposite sides. The casing forms part of a base structure of the massager that also includes a mounting bracket 26 for a drive unit 28 as seen in FIG. 4. In this embodiment, the drive unit is a conventional a.c. electric motor and has a rotary output shaft 30 at one end and a cooling fan 32 at the opposite end, on the same shaft.

Figure 8:
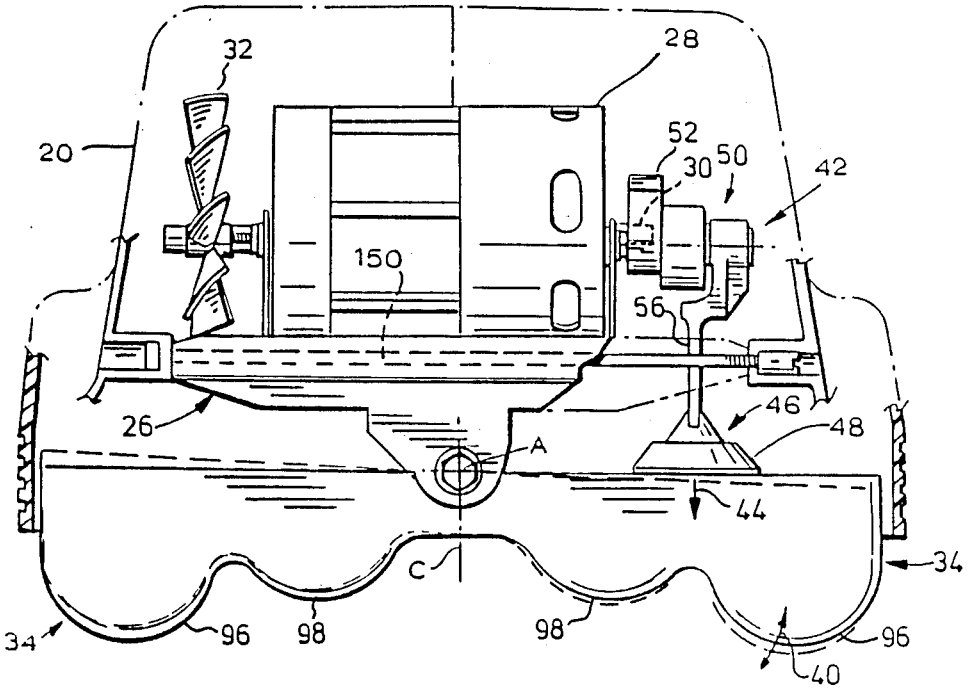
FIG. 8 is a side elevational view, partly in section, of the massager.

The massager also includes a massage head 34 which in this embodiment is a composite of a pair of moulded shells comprising a relatively rigid inner shell 36 and an outer shell 38. The external appearance of the massage head is best shown in FIG. 3 and appears there as seen from the bottom of the massager. The external massage surface is contoured symmetrically about a transverse centre line C as will be described, for percussive massage of the body. As best seen in FIG. 8, the massage head 34 is pivotally coupled to the drive motor mounting brackets 26 (part of the base structure of the massager) for pivotal rocking movement about an axis A disposed parallel to the transverse centre line of the massage head. Arrow 40 in FIG. 8 illustrates the rocking action of the massage head 34 about axis A. This action is produced by a coupling arrangement generally indicated at 42 in FIG. 8 between the drive motor 28 and the massage head 34. The arrangement is designed to cause the motor to reciprocate the massage head in a direction denoted 44 in FIG. 8 in a direction generally normal to the pivot axis A of the massage head at a position spaced from its centre line C.

Details of the coupling arrangement will be described in more detail later. For present purposes, it is sufficient to note that the coupling arrangement 42 includes a resilient link in the area indicated at 46 in FIG. 8 which is alternately compressed and relaxed during reciprocation of the massage head. In this embodiment, the link takes the form of a resilient bush (not visible in FIG. 8) constrained in a housing 48 that can be adjusted to limit the extent to which the bush can compress and relax at each reciprocation so as to control the amplitude of the pivotal rocking movement of the massage head and hence the percussive massage effect applied to the body.

Figure 5:
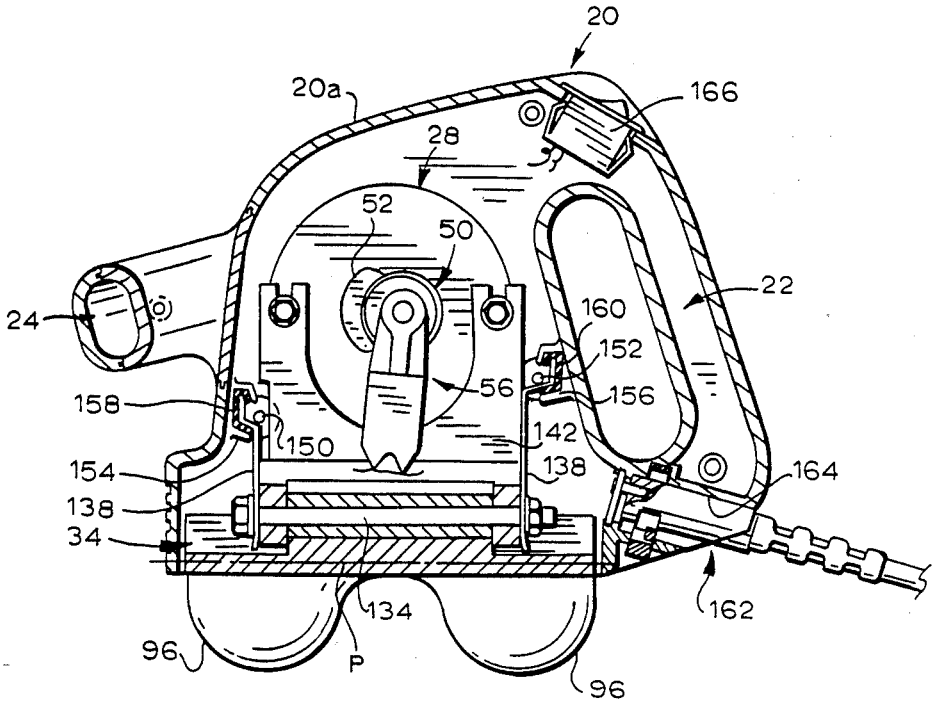
FIGS. 5 and 6 are sectional views taken generally on line V—V and VI—VI respectively of FIG. 4 but with the massager in an assembled condition.
Figure 6:
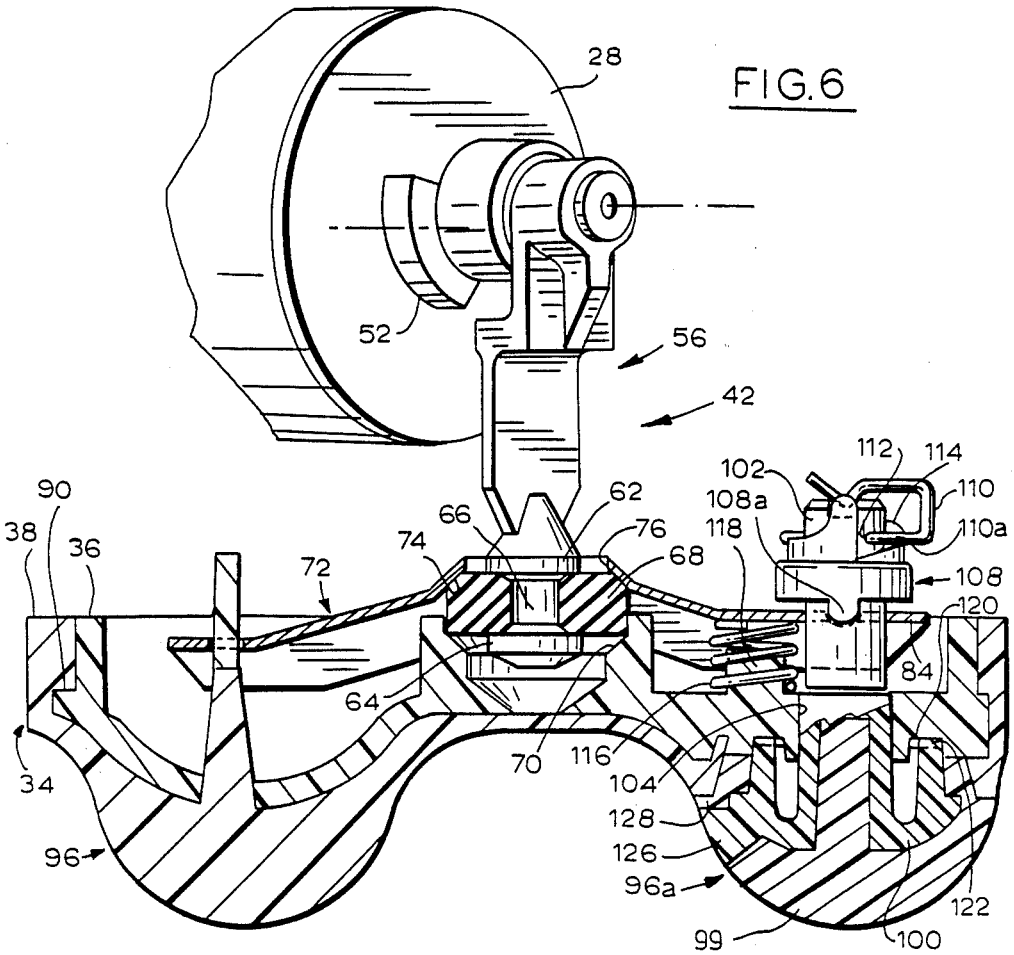

Referring now to the drawings in more detail and particularly to FIGS. 4, 5 and 6 it will be seen that the coupling arrangement 42 includes an eccentric 50 mounted on the drive motor output shaft 30 and an associated eccentric counterbalance weight 52. Weight 52 ensures that the eccentric is dynamically balanced and avoids undesirable vibrations when motor 28 is running. A setscrew 54 for securing the eccentric to the motor output shat is visible in FIG. 4.

A connecting rod 56 extends between the eccentric 50 and the massage head 34 and includes a stub shaft 58 (FIG. 4) received in a bearing 60 in eccentric 50.

Referring now to FIG. 6, the lower end portion of connecting rod 56 is shaped to define a pair of enlarged annular shoulders 62, 64 separated by a narrow "neck" portion 66 around which is fitted a resilient bushing 68 forming the compressible resilient "link" referred to previously. As can best be seen in FIG. 4, bushing 68 is generally of annular form and is trapped between the two shoulders 62, 64 of connecting rod 56. At its lower side, bushing 68 rests on a conical seating surface 70 at the top of the upper shell 36 of massage head 34. A lever 72 a shape of which can best be seen in FIG. 4 provides a corresponding seating surface 74 (FIG. 6) for the top surface of bush 68 and the lever has an opening 76 through which the connector the connecting rod extends. Accordingly, the bushing 68 is constrained between the two seats 70 and 74.

Referring back to FIG. 4, it will be seen that lever 72 engages bushing 68 generally in the region of the centre of its length. Lever 72 is pivotally coupled to the upper shell 36 of massage head 34 at one end while its opposite end can be adjusted vertically to vary the degree of constraint applied to bushing 68. Thus, as seen in FIG. 4, the left-hand end 78 of lever 72 is received in a slot 80 in shell 36 and a tongue 82 on the shell extends through a slot in the lever to in effect capture the lever while allowing it to pivot up and down in a vertical plane. The right-hand end portion 84 of lever 72 co-operates with an adjuster 86 (to be described) that allows the vertical height of that end of the lever to be varied for varying the constraint applied to bushing 68.

Figure 7:
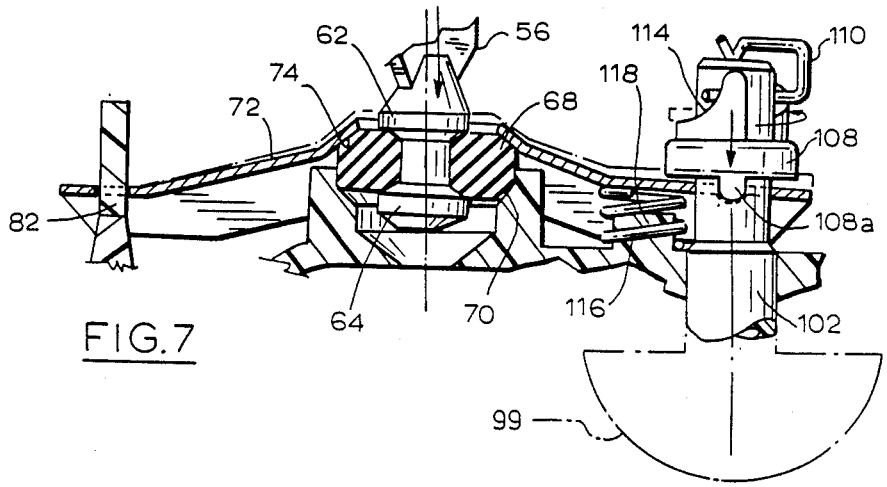
FIG. 7 is a view similar to FIG. 6 showing an adjusted position of the massager.

It will be seen from a comparison of FIGS. 6 and 7 that, in FIG. 6, bushing 68 is relatively lightly constrained as compared with FIG. 7 in which the right-hand end 84 of lever 72 has been moved down to more tightly retain the bush. In the latter configuration, the massage head 34 is relatively tightly coupled to connecting rod 56 while in the FIG. 6 configuration, bushing 68 is allowed to flex so that relative movement can take place between the massage head and the connecting rod within the limits of the resiliency of bush 68. Accordingly, when the lever is adjusted as shown in FIG. 6, the amplitude of the percussive action applied by the massage head will be less than when the lever is adjusted downwardly as shown in FIG. 7 to more tightly constrain bushing 68.

In this particular embodiment, bushing 68 is a microcellular "doughnut" structure and has the characteristics that it does not bulge significantly or generate heat when compressed. Accordingly, it is believed that bushing 68 should be capable of relatively long life. The bushing is resiliently deformable to an extent sufficient to permit it to be distorted to be fitted over the lower shoulder 64 on connecting rod 56 when the massager is assembled. The connecting rod itself is moulded in NYLON 66 (trademark).

Before referring in detail to the adjustment mechanism 86 for lever 72, it may be convenient to describe in more detail the structure of the massage head 34. As mentioned previously, the massage head comprises upper and lower "shells" 36 and 38. Each of these shells is moulded in a plastic material. Shell 36 is relatively rigid and may for example be moulded in foamed polypropylene while shell 38 is relatively resilient and may be moulded in foamed polyurethane. Shell 38 is designed to fit closely over and in effect form the exterior surface of massage head. FIG. 6 shows the two shells fitted together and it will be seen that portions of the outer shell are relatively deep to provide a thick resilient cushion on protruding portions of the massage head. Referring back to FIG. 4, a series of plastic "fingers" 88 are moulded onto the inner surface of shell 38 and extend through corresponding openings (not shown) in shell 36 where they are frictionally retained. Around its perimeter, shell 36 defines a ledge 90 while the corresponding inner surface of shell 38 is complimentarily shaped as best seen in FIG. 6 so that the outer shell will tend to "cling" to the inner shell around its periphery.

As seen in FIG. 4, a rectangular "window" 92 is formed generally in the centre of the outer shell 38 while the inner shell has a corresponding protrusion 94 (FIG. 3) that will extend into and be visible through the window when the two shells are assembled together. The inner shell is preferably coloured red and the outer shell black so that the formation 94 will appear in sharp contrast to the remainder of the exterior surface of the massage head.

FIG. 3 also illustrates the contour of the massage surface of the massage unit. Four relatively large hemispherical formations 96 are provided adjacent the four corners of the massage head while four smaller hemispherical formations 98 are provided inwardly of the outer formations. The respective sets of formations are spaced on either sides of the transverse centre line C and on either side of a corresponding longitudinal centre line L. This configuration has been anatomically designed to present an ideal contour for numerous massage therapy techniques. For example, the massager can be placed transversely across the lap of a person sitting upright with their knees together and the formations 96 will be appropriately positioned for massaging the thighs of both legs at the same time. The massager can also be placed longitudinally in the spine area of the back with the longitudinal centre line between the formations at the position of the spine. All of the formations will then be appropriately positioned for massaging the back on opposite sides of the spine.

One of the four large hemispherical formations 96 also acts as an adjustment knob for the adjustment mechanism 86 discussed previously. In FIG. 3, that knob is denoted by reference numeral 96*a* and the knob is also visible in FIGS. 4, 6, 7 and 9.

Figure 9:
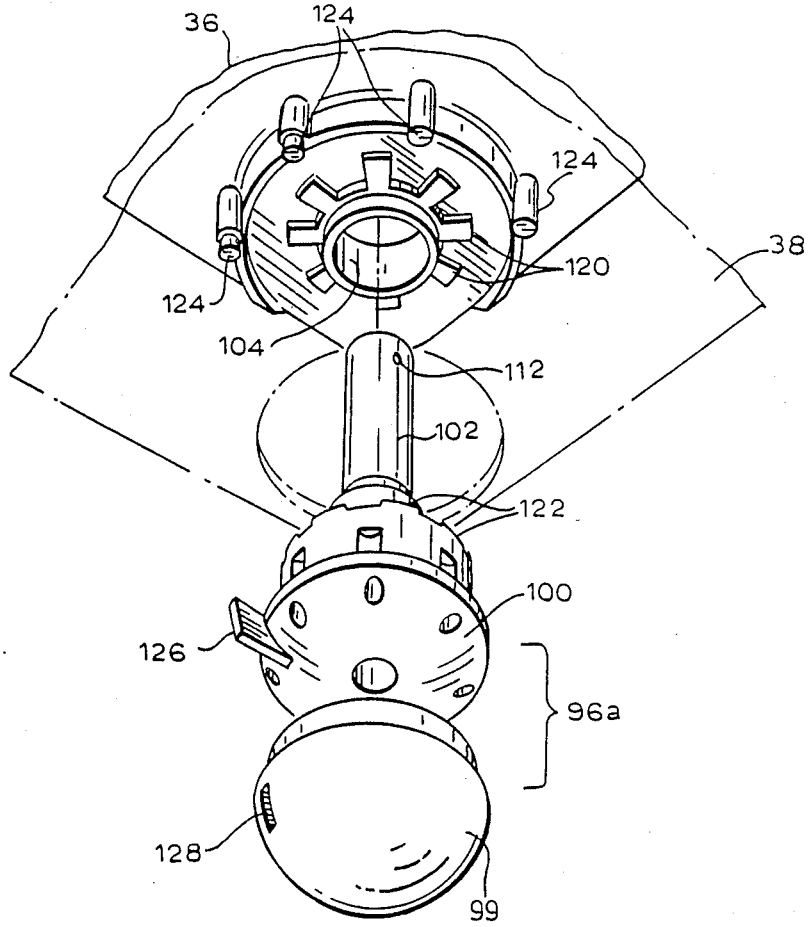
FIG. 9 is a detail exploded perspective view generally in the direction of arrow X in FIG. 4, showing the knob for adjusting the percussive effect of the massager.

FIG. 9 shows the adjustment knob 96*a* as seen from the opposite side as compared with FIG. 3. The knob comprises a cap 99 which is made of the same resilient plastic material as the outer shell 38, and an inner core 100 having a shaft 102 that projects through an opening 104 in the bottom of the inner shell 36. Shaft 102 then extends upwardly through an opening in the right-hand end 84 of lever 72 and through a cam member 108 above lever 72 as best seen in FIG. 6. A spring clip 110 is fitted through an opening 112 adjacent the upper end of shaft 102 and has a horizontal limb 110*a* that rests on a cam surface 114 of cam 108. Cam 108 has a protrusion 108*a* in its lower surface which is received in a complimentary recess in lever 72 so that the cam is restrained from turning with respect to the lever. Accordingly, if shaft 102 is turned by turning knob 96*a*, the spring clip 110 will in effect ride up or down the cam surface 114 (depending on the direction of turning) so that the end 84 of lever 72 will either be pressed down or allowed to rise thereby changing the compressive restraint on bushing 68. The end 84 of lever 72 is in fact biassed upwardly by a spring 116 retained on a moulded post 118 on the inner shell and arranged to press upwardly on the lever 72 adjacent its end 84.

In summary, by turning knob 96*a* the end of lever 72 denoted 84 is raised or lowered depending on the direction of turning thereby correspondingly compressing or releasing bushing 68.

Referring back to FIG. 9, a series of detents 120 are moulded into the inner shell 36 around opening 104 and co-operate with corresponding teeth 122 moulded onto the inner core of knob 96*a*. These co-operating teeth and detents provide for positive location of knob 96*a* in each of a series of adjusted positions. Four posts 124 are moulded into the inner shell outwardly of the detents 102 and act as markers for indicating the position selected by knob 96*a*. The outer ends of these posts are of respectively different diameters and project through corresponding openings in the outer shell so as to be visible from externally of the massager (although not seen in FIG. 3). A corresponding "flag" or indicator 126 is moulded into the knob core 100 and projects through a window 128 in the outer cover of the knob 96*a*. It will be remembered that the inner shell 36 is coloured red while the outer shell is black. Accordingly, the posts 124 will appear as red dots in the massage surface of the massage head 34. Similarly, core 100 is coloured red while the knob cover 98 is coloured black so that the flag 126 will be clearly visible.

Referring back to FIG. 4, the pivot axis for the massage head 34 (see axis "A" in FIG. 8) is defined by a moulded formatin 130 on the inner shell 36 having a transverse opening 132 for receiving a bolt 134 coupling the motor mounting bracket 26 to the massage head. Thus, it will be seen that bracket 26 includes a pair of side rails 136 of angle shape in cross-section having depending lugs 138 formed with openings 140 for receiving bolt 134. Connecting the side rails 136 are a pair of U-shaped end brackets 142 and 144 at which the motor 28 is bolted to the bracket.

Casing 20 of the massager is moulded in two halves that meet at a joint line denoted 146 in FIG. 4 while the inside surface 148 of handle 24 is a separate moulding that is trapped between the two main halves when then are assembled together. The two halves are held together by a pair of bolts, one of which is visible at 150 in FIG. 8 that extend from end to end of the casing along the drive motor support bracket side rails 136 as shown in FIG. 5. There, the two bolts are denoted 150 and 152. Generally C-shaped mouldings 154 and 156 inside the casing embrace the motor mount side rails with the interposition of rubber vibration isolating strips 158 and 160 to locate the casing with respect to the base structure of the massager. FIG. 5 also shows a detachable electrical cord fitment 162 that plugs into an opening 164 in casing 20, and an electrical on/off switch 166 at the top of handle 22. As best seen in FIG. 2, the casing is recessed 168 so that switch 166 is below the profile contour of the handle and is therefore less likely to be accidentally operated during manipulation of the massager. FIGS. 1 and 2 also show openings 170 for supplementary bolts securing the casing halves together.

Referring back to FIGS. 1 to 3, the arrangement of the two handles 22 and 24 on casing 20 is also believed to be an advantageous feature of the invention. The handles are disposed one at each side of the casing generally at opposite ends of the pivot axis for the massage head. Each handle comprises a generally U-shaped formation extending outwardly of the casing with one handle disposed generally parallel to a general plane P (FIG. 5) containing the massage head and the other at right angles to the said plane.

As mentioned previously, this handle configuration allows an operator to mainpulate the massager in many different ways, using one or two hands. For example, referring to FIG. 1, an operator standing on the far side of the massager as drawn could place his or her left arm across the top of the casing 20 and grasp handle 24 with the arm straight while the other arm would be bent while holding handle 22. The massage can then easily traversed generally in an arc outwardly from the users body without undue effort.

It will also be noted from FIG. 5 that the top surface 20*a* of casing 20 slopes downwardly away from the handle 22 towards handle 24. This not only assists in permitting the massager to be held in the way described above but also allows the massager to be conveniently inverted and supported on a generally horizontal surface, for example for massaging the feet.

In summary, the massager shown in the drawings is believed to offer numerous advantages over the prior art including ease of manipulation, effective percussive massage and the facility for controlling the amplitude of the percussive strokes and thereby the intensity of the treatment. In prior art massagers the massage effect can be varied only by changing the frequency of massage by means of a rheostat in the power supply to the drive motor of the massager. By contrast, the massager provided by the invention is superior in that the amplitude and hence the penetration of the massage effect can be varied.

It should of course be appreciated that the preceding description relates to a particular preferred embodiment of the invention only and that many modifications are possible within the broad scope of the invention.

For example, the handle configuration described above could be used with a massage mechanism other than of the form described. Conversely, a different casing could be used with the mechanism described. It probably would also be possible to use a different form of drive unit such as an electrical vibrator mechanism or even a pneumatic drive source. The arrangement used for coupling the drive unit with the massage head may also vary. For example, a cam arrangement could be used for reciprocating the massage head rather than the connecting rod and eccentric arrangement disclosed, and could still incorporate a resilient link.

We claim:

1. A body massager comprising:

a base structure including a casing having handles for manipulating the massager;

a drive unit carried by said base structure;

a massage head having an external massage surface contoured symmetrically about a transverse centre line for percussive massage of the body, the massage head being coupled to the base structure for pivotal rocking movement about an axis parallel to said transverse centre line; and;

means coupling said drive unit with said massage head to reciprocate said massage head in a direction generally normal to said axis at a position spaced from said centre line, for producing said rocking movement of the head;

wherein two said handles are provided and are disposed one at each side of the casing generally at opposite ends of said axis, each said handle comprising a generally U-shaped formation extending outwardly of the casing with one handle disposed generally parallel to a general plane containing the massage head and the other handle at right angles to said plane.

2. A massager as claimed in claim 1, wherein said drive unit is an electric drive motor and wherein one of said handles incorporates an on/off switch for said motor, said switch being disposed in a recess in the handle so that the switch does not project above the profile of the handle in the region of the recess.

3. A body massager comprising:

a base structure including a casing having handles for manipulating the massager;

a drive unit carried by said base structure and comprising an electric motor having a driven rotary output shaft;

a massage head having an external massage surface contoured symmetrically about a transverse centre line for percussive massage of the body, the massage head being coupled to the base structure for pivotal rocking movement about an axis parallel to said transverse centre line; and, means coupling said drive unit with said massage head to reciprocate said massage head in a direction generally normal to said axis at a position spaced from said centre line, for producing said rocking movement of the head, said means including: an eccentric carried by said output shaft; a connecting rod extending between the eccentric and said massage head at said position spaced from the centre line of said massage surface for converting rotary motion of said output shaft into reciprocatory motion of the massage head at said position;

a resilient link which is alternately compressed and relaxed during said reciprocation and which comprises a resilient bushing carried by said connecting rod; and adjustable means constraining said link to limit the extent of said compression and relaxation at each reciprocation, and thereby control the amplitude of said pivotal rocking movement of the massage head, said adjustable means comprising a seat on the massage head and a lever carried by said head, the bushing being constrained between the lever and seat, and the lever being adjustable to vary the constraint applied to the bushing.

4. A massager as claimed in claim 3, wherein said lever is pivotally coupled to said massage head at one end and at its opposite end is provided with adjustment means for varying the height of said lever above said massage head.

5. A massager as claimed in claim 4, wherein said adjustment means comprises a shaft turnably mounted in said massage head and extending through an opening in said end of the lever generally in the direction in which said end is to be adjusted, said shaft being turnable from externally of the massage head while being fixed axially, a stationary annular cam member bearing on said lever and through which said shaft extends, said cam member having a cam surface that progressively curves away from the lever and said shaft being provided with a follower arranged to move up or down said cam surface in response to turning of the shaft, thereby moving the cam member towards or away from the lever depending on the direction in which the shaft is turned, the lever being spring-biassed towards said cam.

6. A massager as claimed in claim 5, wherein said shaft is coupled to a knob contoured to form part of said massage surface of the massage head.

7. A massager as claimed in claim 6, further comprising detent means between said knob and said massage head for determining discrete angular positions of said shaft corresponding to predetermined adjusted positions of said lever, and indicia on said knob and massage head for denoting said positions.

8. A massager as claimed in claim 1, wherein said eccentric includes an eccentric balance weight dynamically balancing said eccentric.

9. A massager as claimed in claim 1, wherein said massage head comprises a relatively rigid inner shell and a resilient outer shell providing cushioned areas of said contoured massage surface, said shells each being moulded in a plastic material.

10. A massager as claimed in claim 1, wherein said massage surface is a generally rectangular shape and is contoured to define four generally hemispherical protrusions adjacent respective corners of the massage surface and four smaller generally hemispherical protrusions disposed inwardly of the corner protrusions, the protrusions being spaced symmetrically on opposite sides of said transverse centre line and being spaced symmetrically on opposite sides of a corresponding longitudinal centre line to provide an anatomically contoured massage surface.

* * * * *